US009861179B2

(12) United States Patent
Kotter

(10) Patent No.: US 9,861,179 B2
(45) Date of Patent: Jan. 9, 2018

(54) SPORT CHAIR BACKPACK

(71) Applicant: Kenneth Coburn Kotter, Mandeville, LA (US)

(72) Inventor: Kenneth Coburn Kotter, Mandeville, LA (US)

( * ) Notice: Subject to any disclaimer, the term of this patent is extended or adjusted under 35 U.S.C. 154(b) by 0 days.

(21) Appl. No.: 15/221,570

(22) Filed: Jul. 27, 2016

(65) Prior Publication Data

US 2017/0143106 A1 May 25, 2017

Related U.S. Application Data

(60) Provisional application No. 62/198,353, filed on Jul. 29, 2015.

(51) Int. Cl.

| | |
|---|---|
| ***A45F 3/04*** | (2006.01) |
| ***A45F 3/10*** | (2006.01) |
| ***A45F 3/08*** | (2006.01) |
| ***A45F 3/14*** | (2006.01) |
| *A45F 3/00* | (2006.01) |

(52) U.S. Cl.

CPC ..... *A45F 3/08* (2013.01); *A45F 3/14* (2013.01); *A45F 3/04* (2013.01); *A45F 3/10* (2013.01); *A45F 2003/003* (2013.01); *A45F 2003/045* (2013.01); *A45F 2003/144* (2013.01); *A45F 2003/146* (2013.01); *A45F 2200/0566* (2013.01)

(58) Field of Classification Search

CPC ..... A45F 3/04; A45F 3/10; A45F 2200/0566
USPC ..... 224/628, 637, 262, 259, 261, 683, 684, 224/251, 917

See application file for complete search history.

(56) References Cited

U.S. PATENT DOCUMENTS

| | | | | | |
|---|---|---|---|---|---|
| 1,109,161 | A * | 9/1914 | Chindgren | A45F 3/14 | 217/28 |
| 3,114,486 | A * | 12/1963 | Flexman | A45F 3/08 | 224/148.6 |
| 3,498,511 | A * | 3/1970 | Marg | F41C 33/003 | 224/149 |
| 3,710,997 | A * | 1/1973 | Asikainen | F42B 39/26 | 206/3 |
| 4,449,654 | A * | 5/1984 | Cappis | A45F 3/16 | 224/148.3 |
| 5,297,708 | A * | 3/1994 | Carpenter | A45F 4/02 | 224/155 |
| D354,393 | S * | 1/1995 | Mocca | 224/259 | |

(Continued)

*Primary Examiner* — Justin Larson

(57) ABSTRACT

Revealed invention relates to a backpack for carrying portable chairs, and/or selected equipment comfortably on the back of a person. Shoulder harness support straps secure it to the back of an individual and the waist harness support transfer the weight to the hips. People attending sporting events, concerts, picnics, or camping many time have an uncomfortable job of carrying several portable chairs, and/or selected equipment, slung over their shoulders for a considerable distance. The bulk and weight of carrying more than one portable chair, and/or selected equipment becomes a frustrating task. Especially if one has to carry up to six chairs, and/or selected equipment, or other items. The Sport chair backpack has six designated locations for chairs, and/or selected equipment to be securely and comfortable, carried over a long distance. Shoulder harness support straps secure it to the back of an individual. Waist harness support transfers the weight to the hips.

6 Claims, 3 Drawing Sheets

(56) References Cited

U.S. PATENT DOCUMENTS 5,470,001 A * 11/1995 Konchan ..... A01K 97/04 224/240
5,893,504 A * 4/1999 Baronian ..... A45F 3/04 224/627
6,662,981 B2 * 12/2003 McUmber ..... A45F 3/10 224/155
6,843,399 B2 * 1/2005 Garcia ..... F42B 39/02 224/665
6,857,820 B2 * 2/2005 Jacoway ..... B63C 11/02 224/627
6,962,278 B2 * 11/2005 Obatake ..... A45F 5/00 224/250
7,100,810 B1 * 9/2006 Bosch ..... F42B 39/02 224/196
7,644,847 B2 * 1/2010 Howell ..... A45F 3/08 224/628
7,703,645 B2 * 4/2010 Moskun ..... A45F 3/08 224/579
8,540,126 B2 * 9/2013 Kawamoto ..... A45F 5/02 224/149
9,049,916 B2 * 6/2015 Berei ..... A45F 3/04
D768,934 S * 10/2016 Osweiler ..... D28/38
2003/0000974 A1 * 1/2003 McUmber ..... A45F 3/10 224/155
2005/0040199 A1 * 2/2005 Lemens ..... A45F 3/14 224/637
2005/0140103 A1 * 6/2005 Marchant ..... A45C 5/14 280/47.26
2007/0108248 A1 * 5/2007 Hoffmeier ..... A45C 5/06 224/650
2008/0078789 A1 * 4/2008 Fiola ..... A45F 3/08 224/155
2008/0185413 A1 * 8/2008 Marques ..... A45F 5/02 224/674
2010/0314423 A1 * 12/2010 Kawamoto ..... A45F 5/02 224/195
2013/0175310 A1 * 7/2013 Turner ..... A45F 3/04 224/637
2014/0209646 A1 * 7/2014 Hoppa ..... A45F 3/08 224/261
2017/0127805 A1 * 5/2017 Kotter ..... A45F 3/10
2017/0143106 A1 * 5/2017 Kotter ..... A45F 3/08

* cited by examiner

SPORT CHAIR BACKPACK

CROSS REFERENCE CITED

U.S. Patent Documents

| | | |
|---|---|---|
| 3,266,686 | August 1966 | Griffith |
| 4,022,292 | May 1977 | Van Gompel |
| 5,409,291 | April 1995 | Lamb and Mora |
| 5,465,887 | November 1995 | Hudson |
| 5,597,101 | January 1997 | Barber |
| 5,957,349 | September 1999 | Drulik |
| 5,975,389 | November 1999 | Braun and Braun |
| 6,986,445 | January 2006 | Stockman |
| 2013/01753310 | July 2013 | Turner, Turner, Moussent |
| 2014/0209646 | July 2014 | Hoppa |

BACKGROUND OF THE INVENTION

This invention pertains to an apparatus that is capable of simultaneously carrying one to six portable chairs, and/or selected equipment, securely and safely.

Another I have designed another backpack, Portable Chair Backpack. If was filed with USPTO Office minutes before this one is being filed. Therefore, I do not have a reference number for you. Although, they are both designed to carry portable chairs, and/or selected equipment the two are different in nature. The Portable Chair Backpack uses the portable chairs, and/or selected equipment to form an external structural frame for the backpack. The Sport Chair Backpack has a molded plate. The search of thousands of patents relating to the Sport Chair Backpack has revealed the uniqueness of the design.

Several patents have been found concerning the carrying of a chair. The backpack chair combination where the backpack converts into a chair or a backpack that carries a metal foldup chair horizontally or where the backpack converts into a hunter's tree stand or another that carries an ice chest and a fold up portable chair on a metal structure frame. If a person needs to carry one specific chair or a cot these are some examples U.S. Pat. No. 3,266,686 Inventor J. E. Griffith, Convertible Pack and Chair, U.S. Pat. No. 6,986,445, Inventor James A. Stockman, Backpack and chair apparatus, U.S. Pat. No. 5,409,291, Inventor Timothy Lamb and Albert Mora, Combined chair and backpack, U.S. Pat. No. 5,975,389, Inventor Joel L Braun and Kimberly F Braun, Backpack with extendable sub-frame, U.S. Pat. No. 5,957,349, Inventor Irvin W. Miller, Tent/Cot/backpack structure, A hunter would desire to use the backpack for carrying his weapons as described in these inventions, U.S. Pat. No. 5,465,887, Inventor Keith Hudson, Archery Bow Backpack Carrier, U.S. Pat. No. 4,754,904, Inventor Alan G. Fischer and Edward P. Fitzgerald, Carrier Assembly for Compound Bow or Firearm. Or if a hunter needs a tree stand, U.S. Pat. No. 4,022,292, Inventor James J. Van Gompel, Portable Tree Stand or Crow's Nest.

For the surfer to carry his board and several other things, there is U.S. Pub. No: US 2013/01753310, Backpack for Elongated Items, Inventors Tierre Turner, Camille Turner, Rene Paul Mousseut, or one that will carry the ice chest and a portable chair, U.S. Pub. No: US 2014/0209646, Bulk Item Backpack, Inventor Thomas Hoppa.

BRIEF SUMMARY OF THE INVENTION

The present invention contemplates a new and innovative backpack for carrying portable chairs, and/or selected equipment safely and securely.

According to the present invention, the Sport Chair Backpack is designed to carry up to six portable chairs, and/or selected equipment comfortable over a short or long distance.

A patent search of over thousands of patents for a similar invention has revealed the uniqueness of this design. Imagine comfortably carrying all your portable chairs, and/or selected equipment tent, canopy, baseball bats, in one safe journey on the Sport Chair Backpack. For the camper, one could hike the tent and portable chairs securely and safely through the mountains to the secluded campsite. Another example, a group traveling to a festival where one has the frustrating and difficult task of carrying the portable chairs and/or selected equipment slung over his/her shoulder, possibly walking over a quarter of a mile or more, as the chair bags straps cut into his/her shoulder with every step! However, someone saved the day! He/she bought a Sport Chair Backpack! Now he/she can with ease and comfort carry all of the chairs and/or selected equipment on the new Sport Chair Backpack.

Each item to be carried has a designated secure location. The three rows of individual security straps secure the items to the backpack to avoid mishaps.

DETAILED DESCRIPTION OF THE INVENTION

Figure 1:
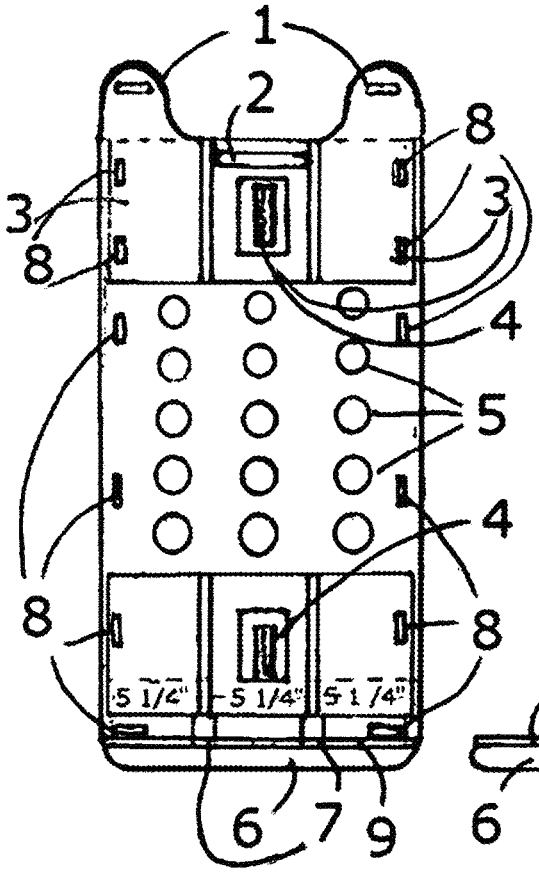
FIG. 1 is the side that faces away from the human body. The view is of the one piece molded backpack-plate or Sport Chair Backpack that actually holds the sport chairs, and/or selected equipment.

FIG. 1 is the side that faces away from the body. The view is of the one piece molded Sport Chair Backpack that actually holds the sport chairs, and/or selected equipment. "1" is the ears with strap holes molded into the backpack. "2" is the handle molded into the backpack. "3" is the U-shape molded slots of the one piece molded back-plate that hold the sport chairs in place. "4" is the shoulder harness and waist harness molded slots for attachment. "5" is fifteen, one inch circular holes for air flow in the center area of the Backpack between the top and the bottom U-shape areas. "6" is the twelve inch by eighteen-inch plate molded into the very bottom of the backpack. It is designed to support the weight of the chairs. "7" is the vertical support for the plate. "8" is the oval strap attachment holes. "9" is the one-inch-high rim encloses the base of each individual chair, and/or selected equipment location, so that the feet of the chairs, and/or selected equipment will not slip out.

Figure 2:
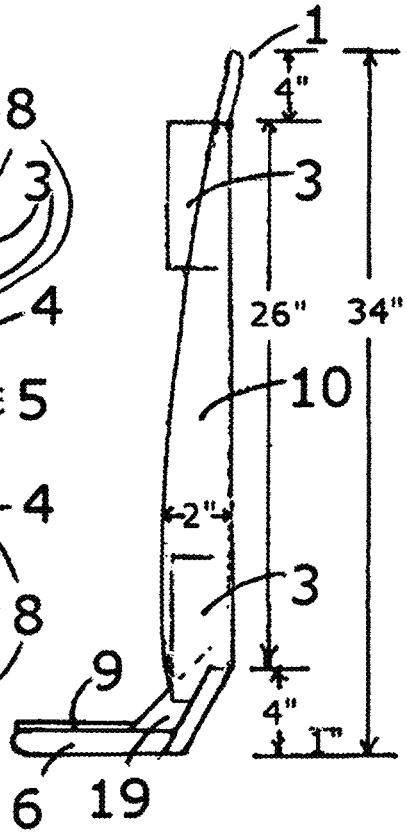
FIG. 2 is the side view of the one piece molded panel backpack.

FIG. 2 is the side view of the one piece molded Backpack. "1" is the two ears are the top of the Backpack. Each ear is three inches wide, four inches high, rounded corners with a half inch high by one and a quarter inch open slot. Each ear is horizontally set twelve inches apart on both top ends of the Backpack. "3" is the U-Shape area are three inches deep then add the one-inch thickness of the backpack you will have four inches. "10" is the concave back area. "7" is the vertical plate support "6" is the bottom plate. "9" is the one-inch-high rim encloses the base of each individual chair, and/or selected equipment location, so that the feet of the chairs, and/or selected equipment will not slip out.

Figure 3:
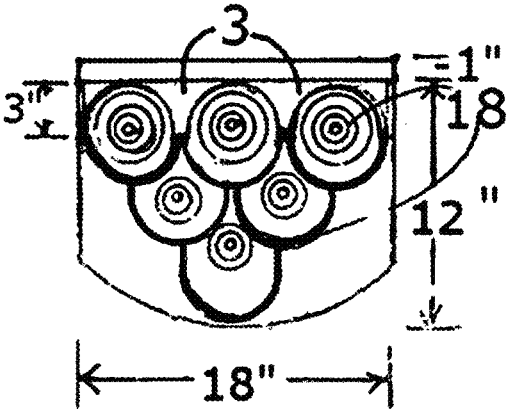
FIG. 3 is a top view of the one piece molded backpack-plate.

FIG. 3 is a top view of the one piece molded backpack. "3" is the U-Shape area are three inches deep then add the one-inch thickness of the Backpack you will have four inches. "6" is the bottom plate. "18" is the folded chairs in place.

Figure 4:
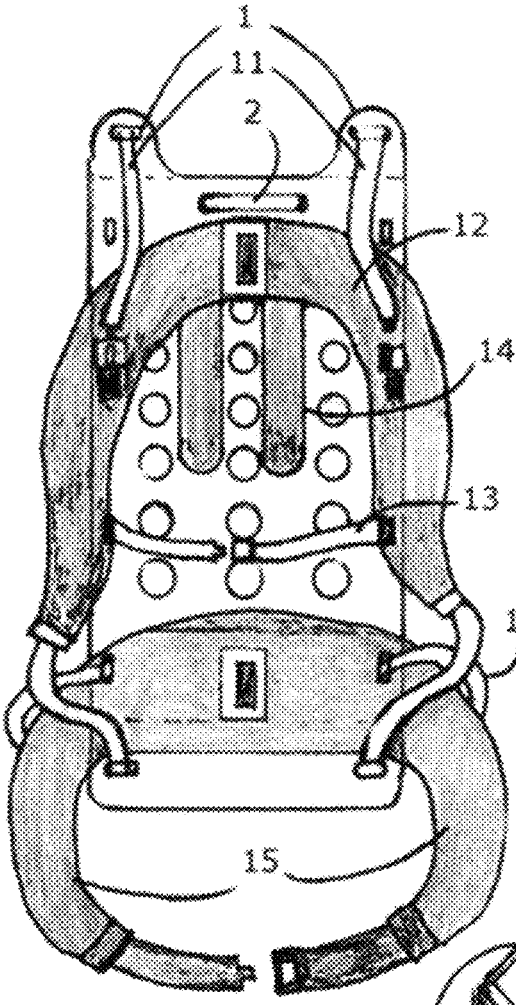
FIG. 4 is the side that faces and attaches to the back of the person carrying the backpack with the shoulder harness, straps, and the waist harness.

FIG. 4 is the side that faces and attaches to the back of the person. "1" is the two ears are the top of the Backpack. Each ear is three inches wide, four inches high, rounded corners with a half inch high by one and a quarter inch open slot. Each ear is horizontally set twelve inches apart on both top ends of the Backpack. "2" is the handle molded into the backpack. "4" is the shoulder harness and waist harness molded attachment slots. "5" is fifteen, one inch circular holes for air flow and reduction of weight of the backpack-plate in the center area of the backpack between the top and the bottom U-Shape areas. "8" is the oval strap attachment holes. "12" is the shoulder harness. "13" is the chest strap. "14" is the two eight by two-inch foam pads are attach with Velcro below the shoulder harness attachment to the backpack on both sides of the center holes. "15" is the waist harness. "16" is the waist stabilizer straps.

Figure 5:
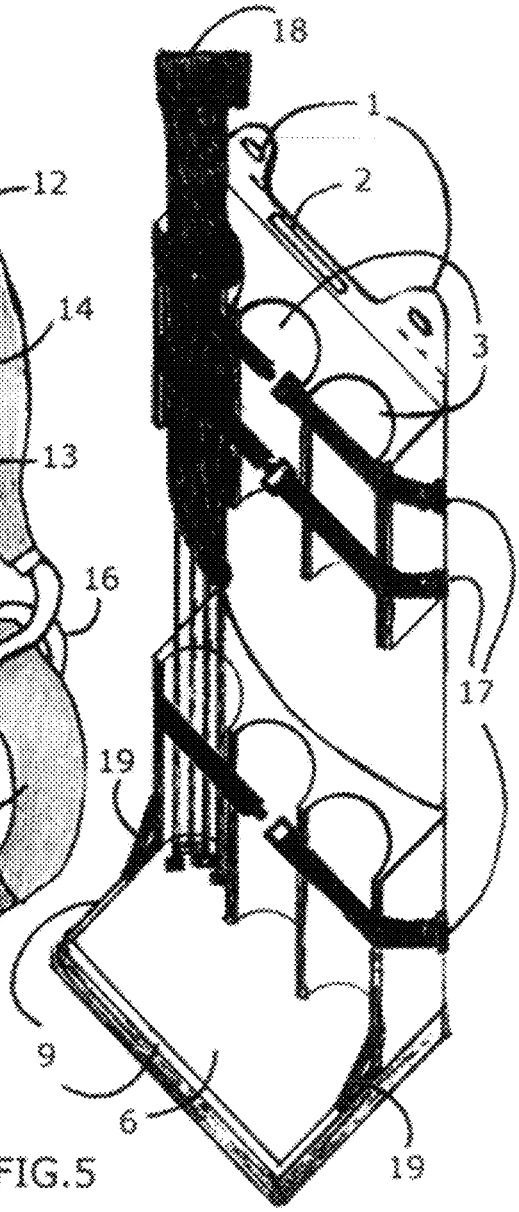
FIG. 5 is the perspective view of the Sport Chair Backpack holding a strapped in sports chair.

FIG. 5 is the perspective view of the backpack holding a strapped in sport chair. "1" is the two ears are the top of the Backpack. "2" is the molded handle. "3" is the U-shape molded slots of the one piece molded backpack-plate that hold the sport chairs in place. "17" is the three five foot straps attached to molded slot on each lateral side of the backpack-plate with a releasable connecter fitting located in the center of each strap to secure the chairs in the U-shape location. Two straps are on the top and one on the bottom. "6" is the twelve inch by eighteen-inch plate molded into the very bottom of the backpack. It is designed to support the weight of the chairs. "9 is the one-inch-high rim encloses the base of each individual chair, and/or selected equipment location, so that the feet of the chairs, and/or selected equipment will not slip out. "19" is the forty-five degree braces.

Figure 6:
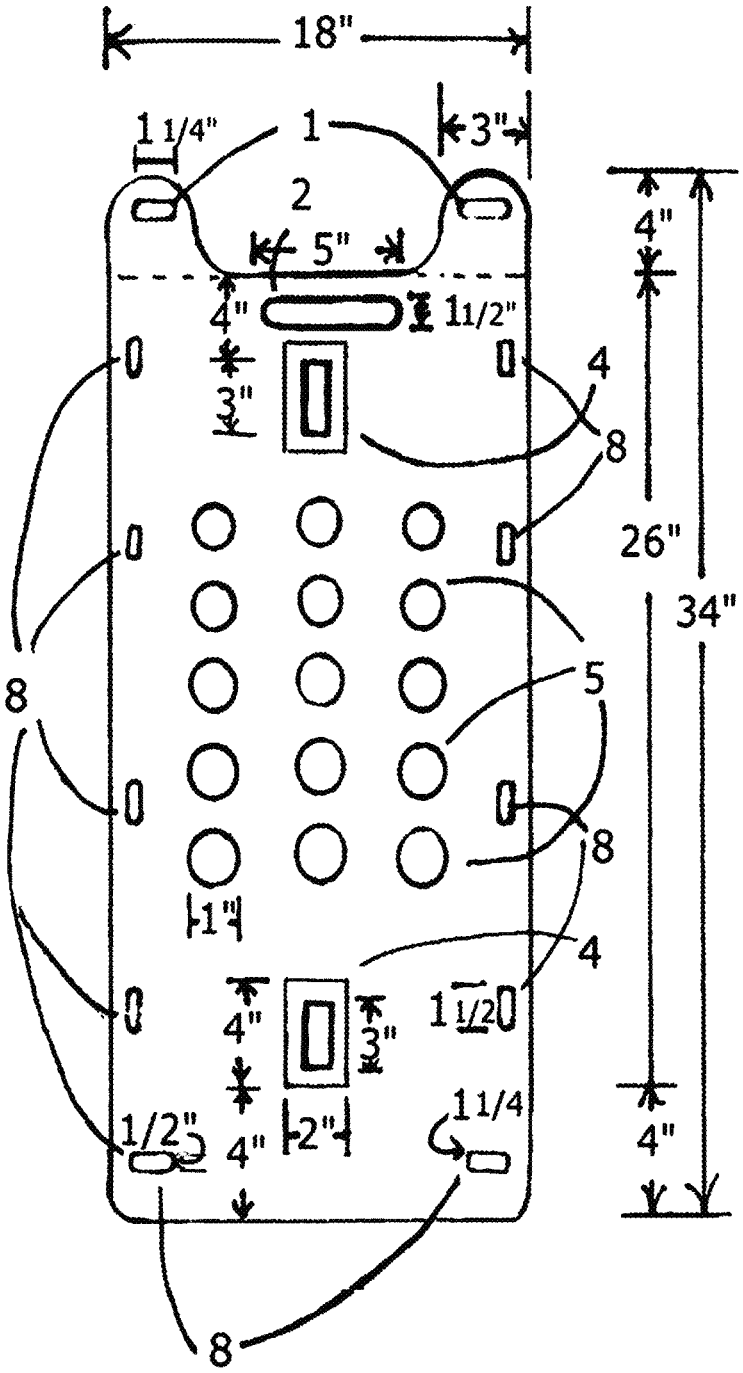
FIG. 6 is the side of the molded backpack plate that attaches to the back of the person without any harnesses or straps.

FIG. 6 is the side of the molded backpack-plate that attaches to the back of the person without any harnesses or straps. "2" is the molded handle. "4" is the shoulder harness and waist harness molded slots for attachment. "5" is fifteen, one inch circular holes for air flow and the reduction of weight in the center area of the backpack-plate. "8" is the oval strap attachment holes.

From the foregoing, it may be seen that the backpack of the present representation is considered illustration or illustrations only of the principles of the invention and may not be drawn to scale and not meant to limit the scope of the invention. Further, since certain changes and modifications such as size, materials, shape, form, function and manner of operation, assembly and use to those skilled in art, the invention shall not be limited to the exact constraints and operation shown and described. Accordingly, all suitable moderations and equivalents may be implemented, falling within the scope of the said invention. Therefore, various changes can be made in the function and assembly of the elements of the said invention—Sport Chair Backpack, without departing from the scope as set forth in the appended claims and the legal equivalents thereof.

The embodiments of the invention in which an exclusive property or privilege is claimed are defined as follows:

1. A backpack for transporting portable chairs and/or selected equipment securely and safely, comprising:

a molded back plate with a top, bottom, left side, right side, front face, and back face;

a first set of U-shape molded slots (3) protruding from an upper end of the front face of the molded back plate, the first set of U-shape molded slots configured to hold an upper portion of chairs and/or other selected equipment against the molded back plate;

a second set of U-shaped molded slots (3) protruding from a lower end of the front face of the molded back plate, the second set of U-shape molded slots configured to hold a lower portion of chairs and/or other selected equipment against the molded back plate;

at least one security strap (17) extending over each set of U-shaped molded slots to retain chairs and/or other selected equipment therein;

a molded base (6) with a molded guard rim (9) protruding from the lower end of the molded back plate to support the chairs and/or other equipment;

and a shoulder harness for securing the backpack to a user's back.

2. The backpack of claim 1, wherein the molded back plate includes a concave surface shaped to fit against a user.

3. The backpack of claim 1, further comprising a molded handle for lifting the backpack.

4. The backpack of claim 1, wherein the first and second sets of U-shaped molded slots each include three slots.

5. The backpack of claim 1, further comprising molded circular holes in the molded back plate to reduce its weight.

6. The backpack of claim 1, wherein the at least one security strap includes a releasable connection for releasably securing around the portable chairs and/or selected equipment.

* * * * *